US008230917B2

(12) United States Patent
Boles et al.

(10) Patent No.: US 8,230,917 B2
(45) Date of Patent: Jul. 31, 2012

(54) METHODS AND SYSTEMS FOR DETERMINATION OF FLUID INVASION IN RESERVOIR ZONES

(75) Inventors: Jeanne Boles, Kellyville, OK (US); Vibhas Pandey, Houston, TX (US); Murtaza Ziauddin, Abu Dhabi (AE)

(73) Assignee: Schlumberger Technology Corporation, Sugar Land, TX (US)

( * ) Notice: Subject to any disclaimer, the term of this patent is extended or adjusted under 35 U.S.C. 154(b) by 163 days.

(21) Appl. No.: 12/554,289

(22) Filed: Sep. 4, 2009

(65) Prior Publication Data

US 2010/0006292 A1 Jan. 14, 2010

Related U.S. Application Data

(62) Division of application No. 11/750,068, filed on May 17, 2007, now abandoned.

(60) Provisional application No. 60/819,330, filed on Jul. 7, 2006.

(51) Int. Cl.
*E21B 47/00* (2012.01)

(52) U.S. Cl. ..... 166/250.01; 702/12

(58) Field of Classification Search ..... 703/10; 166/250.01, 250.02
See application file for complete search history.

(56) References Cited

U.S. PATENT DOCUMENTS

| | | | | |
|---|---|---|---|---|
| 3,480,079 | A | 11/1969 | Wright et al. | |
| 4,520,666 | A | 6/1985 | Coblentz et al. | |
| 5,156,205 | A * | 10/1992 | Prasad | 166/250.02 |
| 5,501,279 | A | 3/1996 | Garg et al. | |
| 6,016,191 | A | 1/2000 | Ramos | |
| 6,502,634 | B1 | 1/2003 | Evans | |
| 6,789,937 | B2 * | 9/2004 | Haddad et al. | 374/136 |
| 7,040,390 | B2 | 5/2006 | Tubel | |
| 7,055,604 | B2 | 6/2006 | Jee | |
| 7,725,301 | B2 * | 5/2010 | Shah et al. | 703/10 |
| 2004/0040707 | A1 | 3/2004 | Dusterhoft et al. | |
| 2004/0129418 | A1 | 7/2004 | Jee et al. | |
| 2005/0016730 | A1 | 1/2005 | McMechan et al. | |
| 2005/0035944 | A1 | 2/2005 | Itoh | |
| 2005/0149264 | A1 | 7/2005 | Tarvin et al. | |
| 2005/0246104 | A1 | 11/2005 | De Guzman et al. | |
| 2006/0155473 | A1 | 7/2006 | Soliman et al. | |
| 2006/0196659 | A1 | 9/2006 | Jee | |
| 2006/0201674 | A1 | 9/2006 | Soliman et al. | |
| 2007/0095528 | A1 | 5/2007 | Ziauddin | |

FOREIGN PATENT DOCUMENTS

| | | | |
|---|---|---|---|
| WO | WO 2004/076816 | * | 9/2004 |
| WO | 2005035944 A1 | | 4/2005 |
| WO | 2005064297 A1 | | 7/2005 |

* cited by examiner

*Primary Examiner* — Angela M DiTrani

(74) *Attorney, Agent, or Firm* — Michael Flynn; Robin Nava; Charlotte Rutherford

(57) ABSTRACT

Methods and systems are described for stimulating a subterranean hydrocarbon-bearing reservoir, one method comprising contacting the formation with a treating fluid, and monitoring the movement of the treating fluid in the reservoir by providing one or more sensors for measurement of temperature and/or pressure which is disposed on a support adapted to maintain a given spacing between the sensors and the fluid exit. In some embodiments the support is coiled tubing.

17 Claims, 5 Drawing Sheets

METHODS AND SYSTEMS FOR DETERMINATION OF FLUID INVASION IN RESERVOIR ZONES

CROSS-REFERENCE TO RELATED APPLICATIONS

The present application is a divisional of U.S. patent application Ser. No. 11/750,068 filed on May 17, 2007 now abandoned, which in turn claims priority under 35 U.S.C. §119(e) to U.S. Provisional Patent Application Ser. No. 60/819,330 filed on Jul. 7, 2006.

BACKGROUND OF THE INVENTION

1. Field of Invention

The present invention relates generally to methods for stimulating hydrocarbon-bearing formations, i.e., to increase the production of hydrocarbon oil and/or gas from the formation and more particularly, to methods for monitoring fluid placement during matrix treatments. The invention also relates to increasing injectivity of an injector.

2. Related Art

Hydrocarbons (oil, natural gas, etc.) are obtained from a subterranean geologic formation (i.e., a "reservoir") by drilling a well that penetrates the hydrocarbon-bearing formation and thus causing a pressure gradient that forces the fluid to flow from the reservoir to the well. Often, well production is limited by poor permeability either due to naturally tight formations or due to formation damages typically arising from prior well treatment, such as drilling.

To increase the net permeability of a reservoir, it is common to perform a well stimulation treatment. A common stimulation technique consists of injecting an acid that reacts with and dissolves the formation damage or a portion of the formation thereby creating alternative flow paths for the hydrocarbons to migrate through the formation to the well. This technique known as acidizing (or more generally as matrix stimulation) may eventually be associated with fracturing if the injection rate and pressure is enough to induce the formation of a fracture in the reservoir.

Fluid placement is critical to the success of stimulation treatments. Natural reservoirs are often heterogeneous; the fluid will preferentially enter areas of higher permeability in lieu of entering areas where it is most needed. Each additional volume of fluid follows the path of least resistance, and continues to invade in zones that have already been treated. Therefore, it is difficult to place the treating fluids in severely damaged and lower permeability zones.

In order to control placement of treating fluids, various techniques have been employed. Mechanical techniques involve for instance the use of ball sealers and packers and of coiled tubing placement to specifically spot the fluid across the zone of interest. Non-mechanical techniques typically make use of gelling agents as diverters for temporarily impairing the areas of higher permeability and increasing the proportion of the treating zone that goes into the areas of lower permeability.

Therefore, for evaluation and optimization of matrix treatments it is of interest to measure the placement of treating fluids. The present invention determines fluid placement in the reservoir by the measurement and interpretation of one or more of temperature, pressure, and flow rate of fluids injected into the wellbore and close to the fluid exit from an oilfield tubular, such as coiled tubing, using special diagnostic plots.

Some techniques have been proposed for tracking fluid movement in the wellbore such as temperature measurements, spinners and logging devices (for example gamma ray logs) used in combination with radioactive tracers in the fluids. Temperature measurement technologies have focused mainly on an array of temperature sensors (see published U.S. Patent Application Number 20040129418 A1) that allows one to obtain real time temperature profiles for interpretation to support the decision making and/or design modification process. To acquire the temperature profile, the current practice is to maintain the CT/optical fiber sensors stationary in the well to allow the well to stabilize, before taking a "snap shot" of the temperature profile of the well.

Published Patent Applications US20050263281, WO2005116388, US20050236161 and WO2005103437 describe technology to communicate between downhole sensors and the surface to enable real time decision making based on accurate (0.01% accuracy) bottomhole pressure and temperature (1% accuracy) gauges. The technologies outlined in these documents are primarily directed to the measurement and telemetry but not interpretation of the measured data.

The main problems with conventional stimulation/fluid diversion methods and systems are that interpretation of the measurements, whether gathered in realtime or delayed, may be difficult. In most cases, interpretation will come hours after the data is collected. If the telemetry system is not hardwired to the surface, the delay time/data time to the surface also becomes a hardship on timing for interpretation. Another problem with conventional stimulation diversion processes and systems is that the measurements were not designed to provide a qualitative answer to the service that is being performed. One of the many services is flow diversion of fluid into a reservoir section of a well. Another problem with conventional stimulation diversion processes and systems is that they were never designed to run on the end of oilfield tubulars such as coiled tubing. This is especially true for the logging tool flow meters which are designed to be run on the end of cable. This makes them vulnerable to damage. Existing systems also typically use a wired cable in the coiled tubing that increases weight while decreasing reliability.

From the above it is evident that there is a need in the art for new methods and new tools to perform the methods that allow monitoring of fluid placement in hydrocarbon-bearing reservoirs in real time.

SUMMARY OF THE INVENTION

In accordance with the present invention, methods and systems (also referred to herein as tools or downhole tools) for practicing the methods are described that reduce or overcome problems in previously known methods and systems for determination of fluid flow in hydrocarbon reservoirs.

A first aspect of the invention are methods for stimulating a subterranean hydrocarbon-bearing reservoir, one method comprising:

(a) contacting the formation with a treating fluid, (b) monitoring the movement of said treating fluid in said reservoir by providing one or more sensors for measurement of temperature and/or pressure, wherein the sensors are disposed on a support adapted to maintain a given spacing between the sensors and the fluid exit.

Methods within the invention may further comprise adjusting the composition of the treating fluid and injection rates and/or pressure of the fluid in response to the measurements made; methods wherein the adjusting step is made in real time; methods wherein the support of sensors is coiled tubing; methods wherein the support extends substantially along the full length of the well; and methods wherein fluids are injected from different flow paths.

One set of methods within the invention comprises:

(a) inserting a tubular into a wellbore, the tubular comprising a section of tubing having at least one fluid injection port and at least one temperature sensor placed at a known location on the tubular;

(b) injecting a fluid through the at least one fluid injection port;

(c) generating, in real time or at a later time, diagnostic plot curves of temperature derivative with respect to time and temperature derivative with respect to coiled tubing depth, both obtained at a known fixed distance from the fluid injection port; and (d) interpreting shape of the curves to determine location of regions of a hydrocarbon-bearing reservoir exhibiting flow of the injected fluid, where the flow ranges from zero to a non-zero value.

Methods in accordance with this aspect of the invention allow for monitoring fluid placement during matrix treatments by measuring the temperature of the wellbore fluids at a fixed distance from the fluid injection point. Certain methods within this aspect of the invention rely on gathering bottomhole temperature and then using specialized diagnostic plots to estimate the placement of fluids. Certain methods employ plot curve interpretation algorithms for temperature and/or pressure to identify regions in cased or open-hole wells that are readily accepting fluids (i.e., flow is non-zero), when any of the fluid types, for example acid, brine, foams, and the like, are being pumped, using a tubular during a matrix treatment. This aspect of the invention proposes generating diagnostic plots of temperature derivative with respect to time and coiled tubing depth, t*dT/dt and D*dT/dD vs. time (T=Temp, t=time, D=CT Depth), optionally as the data is obtained in real time or non-real-time, optionally "smoothed" to reduce any "noise" in the data (if necessary), and then used to interpret the shape of the curve to determine "active" regions of the reservoir that are readily accepting, marginally accepting, or rejecting the injected fluids. Methods within the invention may be used with inert as well as reactive fluids, and while maintaining the tubular stationary as well as moving the tubular.

Another method of the invention comprises:

(a) inserting a tubular into a wellbore, the tubular comprising a section of tubing having at least one fluid injection port and at least one temperature sensor placed at a known location on the tubular; and (b) injecting a fluid through the tubular and through the at least one fluid injection port;

(c) measuring time of arrival of the injected fluid at the temperature sensor.

Methods within this aspect include providing two or more temperature sensors and measuring the time for the injected fluid to travel between two temperature sensors. For example, if a slug of a fluid of low thermal conductivity (such as foam) is pumped through the tubular, the time of arrival of the low conductivity fluid can be observed at a sensor at a known distance upstream or downstream of the fluid injection point.

Another method of the invention comprises:

(a) inserting a tubular into a wellbore, the tubular comprising a section of tubing having at least one fluid injection port and at least one temperature sensor placed at a known location on the tubular;

(b) injecting a first fluid through the tubular and through at least one fluid injection port, the first fluid having a first fluid property value;

(c) injecting a second fluid through an annulus between the tubular and the wellbore, the second fluid having a second fluid property value that is different from the first fluid property value; and (d) measuring a differential between the first and second fluid property values.

Methods within this aspect of the invention may include tracking a fluid interface between two fluids when there are multiple injection paths in the wellbore. For example, there may be injection of acid through the tubular and injection of brine through the annulus defined between the tubular and production tubing. Methods within the invention include tracking the fluid interface based on the difference in the temperature of the fluids. If the interface is not at the desired location in the wellbore, the methods may comprise adjusting flow rate of one or both fluids to move the interface to a desired location.

Yet another method of the invention comprises:

(a) predicting a temperatures at one or more sensors placed at known locations on a tubular to be injected into a wellbore of a reservoir as a function of reservoir permeability distribution;

(b) inserting the tubular into the wellbore, the tubular comprising at least one fluid injection port;

(c) injecting a fluid through the at least one fluid injection port;

(d) measuring actual temperatures at the one or more sensors; and (e) calculating error between the predicted and the measured temperatures, and minimizing the errors by iteratively adjusting the permeability distribution along the wellbore length.

In these latter methods, an inverse model may be to calculate the permeability distribution in the reservoir from a measured temperature response at one or more temperature sensors. Certain methods within this aspect of the invention may employ numerical simulation to predict the temperatures at the sensors as a function of reservoir permeability distribution. The error in the predicted and the measured values can be minimized by iteratively adjusting the permeability distribution along the well length.

In all methods and systems of the invention, while the discussion primarily focuses on use of coiled tubing (CT), the tubular may be selected from coiled tubing and sectioned pipe wherein the sections may be joined by any means (welded, screwed, flanged, and the like), and combinations thereof. Methods of the invention include those wherein the injecting of the fluid is through the tubular to a bottom hole assembly (BHA) attached to the distal end of the tubular. Other methods of the invention include determining differential flow by monitoring, programming, modifying, and/or measuring one or more parameters selected from temperature, pressure, rotation of a spinner, measurement of the Hall effect, volume of fluids pumped, fluid flow rates, fluid paths (annulus, tubing or both), acidity (pH), fluid composition (acid, diverter, brine, solvent, abrasive, and the like), conductance, resistance, turbidity, color, viscosity, specific gravity, density, and combinations thereof. Yet other methods of the invention are those wherein the measured parameter is measured at a plurality of points upstream and downstream of the of the fluid injection point. One advantage of systems and methods of the invention is that fluid volumes and time spent on location performing the fluid treatment/stimulation may be optimized.

Exemplary methods of the invention include evaluating, modifying, and/or programming the fluid diversion in real-time to ensure treatment fluid is efficiently diverted in a reservoir. By determining more precisely the placement of the treatment fluid(s), which may or may not include solids, for example slurries, the inventive methods may comprise controlling the injection via one or more flow control devices and/or fluid hydraulic techniques to divert and/or place the fluid into a desired location that is determined by the objectives of the operation.

Methods in accordance with the invention may be used prior to, during and post treatment, and any combination thereof, including during all of these.

Another aspect of the invention are systems, one system comprising:

(a) a tubular comprising a section of tubing having at least one fluid injection port and at least one temperature sensor placed at a known location on the tubular;

(b) a pump for injecting a fluid through the at least one fluid injection port;

(c) a unit for generating, in real time or at a later time, diagnostic plot curves of temperature derivative with respect to time and temperature derivative with respect to coiled tubing depth, both obtained at a known fixed distance from the fluid injection port; and (d) a curve shape interpreting unit for interpreting the curves to determine location of regions of a hydrocarbon-bearing reservoir exhibiting flow of the injected fluid, where the flow ranges from zero to a non-zero value.

Another system of the invention comprises:

(a) a tubular comprising a section of tubing having at least one fluid injection port and at least one temperature sensor placed at a known location on the tubular;

(b) a pump for injecting a fluid through the tubular and through the at least one fluid injection port; and (c) a measuring unit for measuring time of arrival of the injected fluid at the temperature sensor.

Another system within the invention comprises:

(a) a tubular comprising a section of tubing having at least one fluid injection port and at least one temperature sensor placed at a known location on the tubular;

(b) a first pump for injecting a first fluid through the tubular and through at least one fluid injection port, the first fluid having a first fluid property value;

(c) a second pump for injecting a second fluid through an annulus between the tubular and the wellbore, the second fluid having a second fluid property value that is different from the first fluid property value; and (d) a measuring unit for measuring a differential between the first and second fluid property values.

Yet another system of the invention comprises:

(a) a prediction unit for predicting a temperature at one or more sensors placed at known locations on a tubular to be injected into a wellbore of a reservoir as a function of reservoir permeability distribution;

(b) means for inserting the tubular into the wellbore, the tubular comprising at least one fluid injection port;

(c) a pump for injecting a fluid through the tubular and the at least one fluid injection port;

(d) a measuring unit for measuring actual temperatures at the one or more sensors; and (e) a calculation unit for calculating error between the predicted and the measured temperatures, and for minimizing the errors by iteratively adjusting the permeability distribution along the wellbore length.

Methods and systems of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which.

Figure 1:
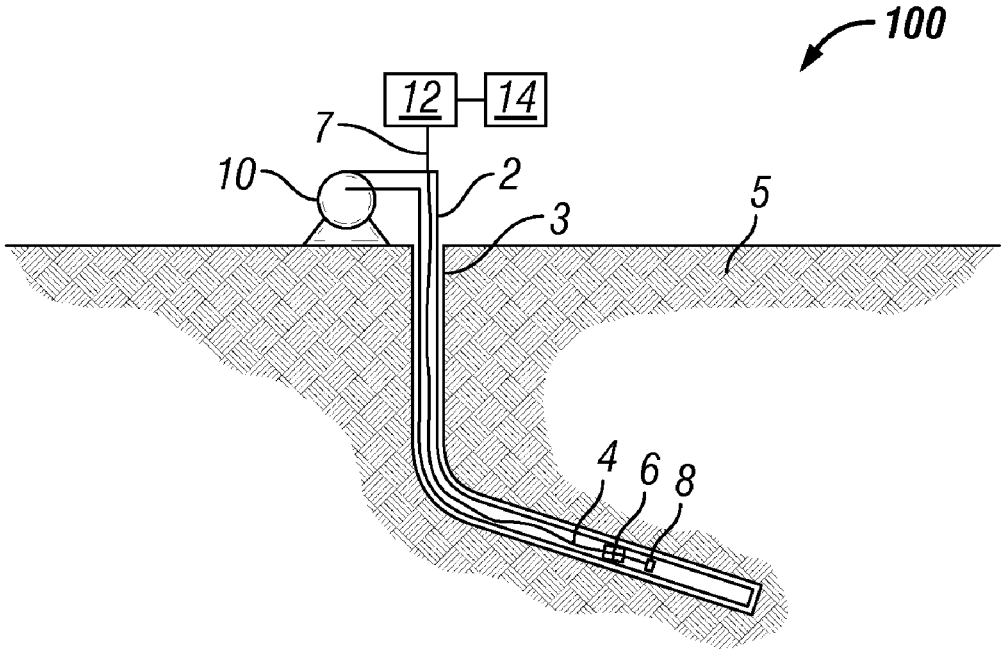
FIGS. 1, 2, 3, and 4 are schematic diagrams of systems of the invention.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

As used herein "oilfield" is a generic term including any hydrocarbon-bearing geologic formation, or formation thought to include hydrocarbons, including onshore and offshore. As used herein when discussing fluid flow, the terms "divert", "diverting", and "diversion" mean changing the direction, the location, the magnitude or all of these of all or a portion of a flowing fluid. A "wellbore" may be any type of well, including, but not limited to, a producing well, a non-producing well, an experimental well, and exploratory well, and the like. Wellbores may be vertical, horizontal, some angle between vertical and horizontal, and combinations thereof, for example a vertical well with a non-vertical component.

As mentioned previously, to increase the net permeability of a reservoir, it is common to perform a well stimulation treatment. A common stimulation technique consists of injecting an acid that reacts with and dissolves the formation damage or a portion of the formation thereby creating alternative flow paths for the hydrocarbons to migrate through the formation to the well. This technique known as acidizing (or more generally as matrix stimulation) may eventually be associated with fracturing if the injection rate and pressure is enough to induce the formation of a fracture in the reservoir.

Fluid placement is critical to the success of stimulation treatments. Natural reservoirs are often heterogeneous; the fluid will preferentially enter areas of higher permeability in lieu of entering areas where it is most needed. Each additional volume of fluid follows the path of least resistance, and continues to invade in zones that have already been treated. Therefore, it is difficult to place the treating fluids in severely damaged and lower permeability zones.

In order to control placement of treating fluids, various techniques have been employed. Mechanical techniques involve for instance the use of ball sealers and packers and of coiled tubing placement to specifically spot the fluid across the zone of interest. Non-mechanical techniques typically make use of gelling agents as diverters for temporarily impairing the areas of higher permeability and increasing the proportion of the treating zone that goes into the areas of lower permeability.

Therefore, for evaluation and optimization of matrix treatments it is of interest to measure the placement of treating fluids. The present invention determines fluid placement in the reservoir by the measurement and interpretation of one or more of temperature, pressure, and flow rate of fluids injected into the wellbore and close to the fluid exit from an oilfield tubular, such as coiled tubing, using special diagnostic plots.

Methods in accordance with the invention may be used prior to, during and post treatment, and any combination thereof, including during all of these. Using one or more methods within the invention prior to reservoir treatment will allow estimation of formation damage in each layer of the reservoir from measurements of injection of an inert fluid, such as brine, along some or all of the entire length of the wellbore. The bottomhole temperature data gathered during the injection test can be interpreted in real time by the method proposed and "zones of interest" can be identified.

Use of one or more methods within the present invention during the treatment will allow monitoring and optimization of the treatment in real time. The data may be transmitted to the surface (such as, by a stream of optical signals) and may be displayed on a computer screen, personal digital assistant, cellular phone, or other electronic device for real time interpretation. Placement of fluids in the formation may be optimized in real time by the use of diversion agents such as foam, inflatable open hole packers, fibers, and the like, and combinations thereof, to divert the stimulation where desired to potential zones. For example, if one finds that a certain reservoir layer is not being treated the injection rate of the fluids or the diverter volume or type may be changed or adjusted to divert the treating fluids to that layer.

Post treatment use of one or more methods within the present invention will allow evaluation of the effectiveness of the treatment by monitoring the injection of an inert fluid (such as brine used for post flush) to evaluate the stimulation achieved in each zone. Alternatively the entire data set may be recorded and analyzed post treatment (such as when telemetry equipment is not available).

Methods of the invention allow for monitoring fluid placement during matrix treatments by measuring temperature of the wellbore fluids at a fixed distance from the fluid injection point. The methods of the invention rely on gathering temperatures and/or pressures, and in certain methods using specialized diagnostic plots to estimate the placement of fluids.

Systems of the invention are exemplified in four embodiments illustrated in FIGS. 1-4, wherein like numerals are employed to described like components unless otherwise noted. It should be pointed out that the system embodiments illustrated in FIGS. 1-4 are illustrative only, and not intended to be limiting in any way. FIG. 1 illustrates embodiment 100, including a tubular 2 inserted in a cased or uncased wellbore 3 in a formation 5, tubular 2 comprising a section of tubing 4 having at least one fluid injection port 6 and at least one temperature sensor 8 attached at a known location on tubular section 4. System 100 includes a pump 10 for injecting a fluid through tubular 2, tubular section 4, and the at least one fluid injection port 6 and into formation 5. A unit 12 allows generating, in real time or at a later time, diagnostic plot curves of temperature derivative with respect to time and temperature derivative with respect to coiled tubing depth, both obtained at a known fixed distance from the fluid injection port. A communication link 7 connects temperature sensor 8 with unit 12, and optionally other units not illustrated. Communication link 7 may be fiber optic, hard wire, or wireless. A curve shape interpreting unit 14 allows for interpreting the curves generating by unit 12 to determine location of regions of a hydrocarbon-bearing reservoir exhibiting flow of the injected fluid, where the flow ranges from zero to a non-zero value.

Figure 2:
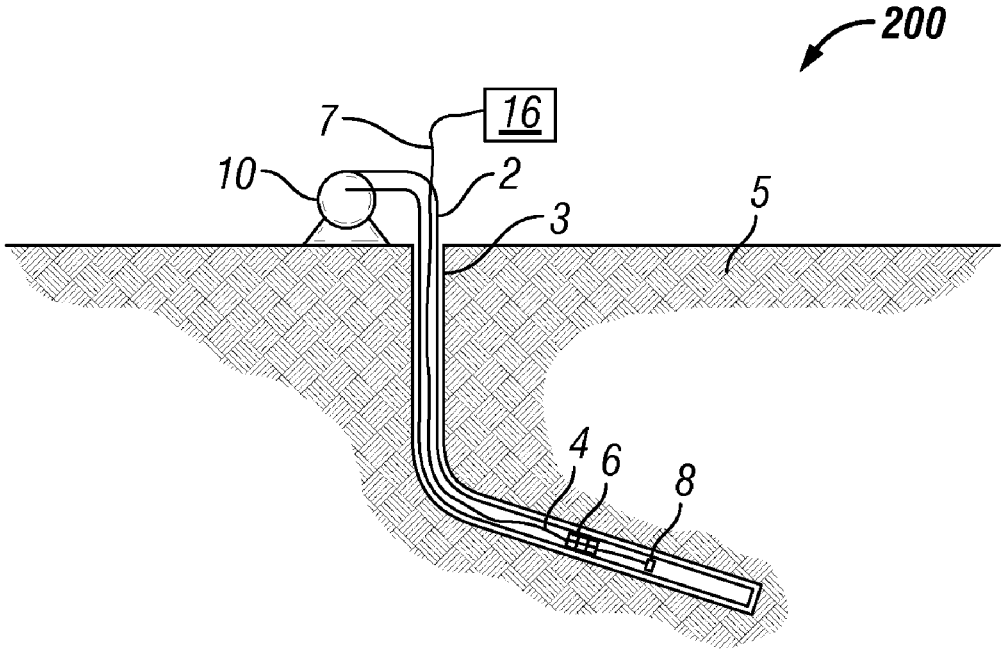

Referring now to FIG. 2 there is illustrated schematically another system embodiment 200 within the invention, comprising a tubular 2 inserted in a cased or uncased wellbore 3 in a formation 5, tubular 2 comprising a section of tubing 4 having at least one fluid injection port 6 and at least one temperature sensor 8 placed at a known location on tubular section 4. System 200 also includes a pump 10 for injecting a fluid through tubular 2, tubular section 4 and the at least one fluid injection port 6. System 200 includes a measuring unit 16 for measuring time of arrival of the injected fluid at temperature sensor 8. A communication link 7 connects temperature sensor 8 with unit 16, and optionally other units not illustrated. Communication link 7 may be fiber optic, hard wire, or wireless. Although communication link 7 is illustrated as traversing through tubular 2 and tubular section 4, link 7 may traverse in the annulus between tubular 2 and wellbore or production casing 3.

Figure 3:
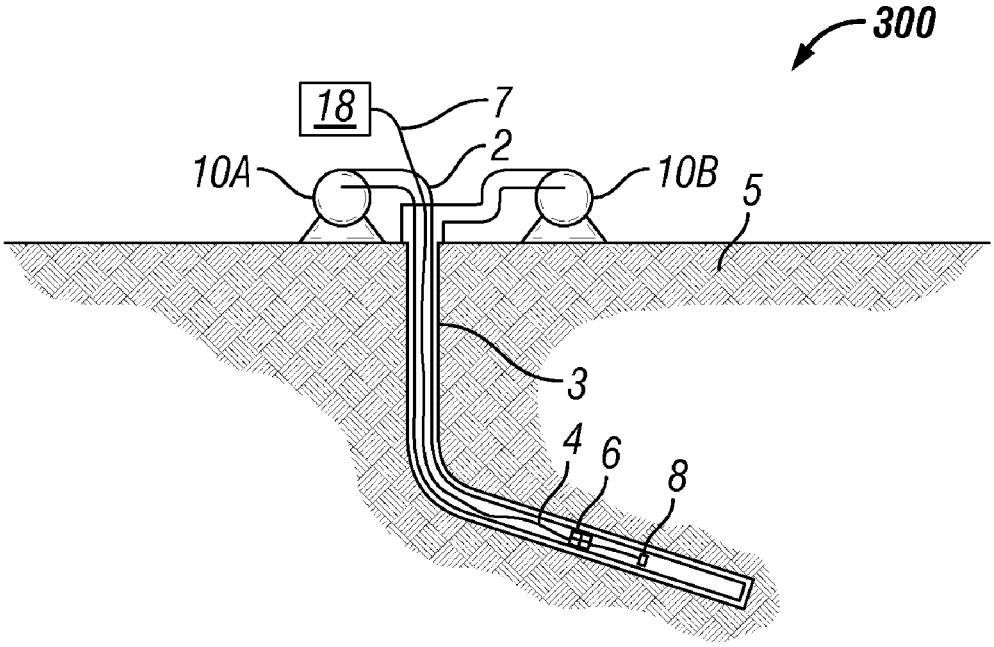

FIG. 3 illustrates schematically another system embodiment 300 within the invention, and includes a tubular 2 inserted in a cased or uncased wellbore 3 in a formation 5, tubular 2 comprising a section of tubing 4 having at least one fluid injection port 6 and at least one sensor 8 placed at a known location on tubular section 4. System 300 includes a first pump 10*a* for injecting a first fluid through tubular 2, tubular section 4, and the at least one fluid injection port 6, the first fluid having a first fluid property value, and a second pump 10*b* for injecting a second fluid through an annulus between tubular 2 and the cased or uncased wellbore 3, the second fluid having a second fluid property value that is different from the first fluid property value. System 300 includes a measuring unit 18 for measuring a differential between the first and second fluid property values. The first and second properties may be temperature, pressure, flow rate, conductance, or some other measurable parameter. A communication link 7 connects sensor 8 with unit 18, and optionally other units not illustrated. Communication link 7 may be fiber optic, hard wire, or wireless. Although communication link 7 is illustrated as traversing through tubular 2 and tubular section 4, link 7 may traverse in the annulus between tubular 2 and wellbore or production casing 3.

Figure 4:
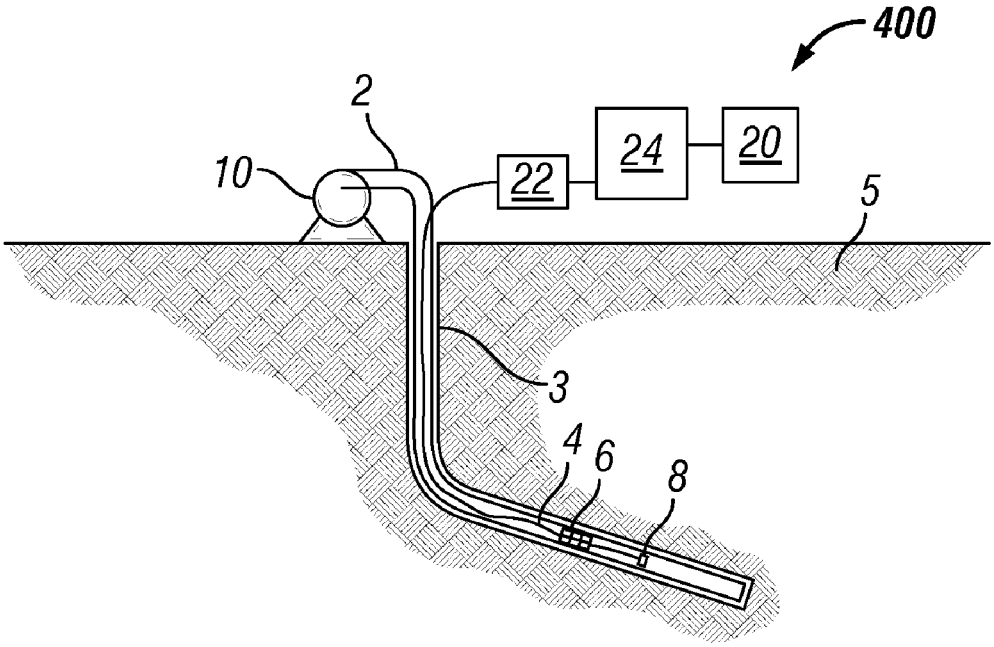

FIG. 4 illustrates schematically a fourth system embodiment 400 within the invention, and comprises a prediction unit 20 for predicting temperature as a function of reservoir permeability distribution at one or more sensors placed at known locations on a tubular 2 injected into a cased or uncased wellbore 3 of a formation 5. Tubular 2 comprises a tubular section 4 having at least one fluid injection port 6; a pump 10 for injecting a fluid through tubular 2, tubular section 4, and the at least one fluid injection port 6, and a measuring unit 22 for measuring actual temperatures at the one or more temperature sensors 8 attached to or integral with tubular section 4. System 400 further includes a calculation unit 24 for calculating error between the predicted and the measured temperatures, and for minimizing the errors by iteratively adjusting the permeability distribution along the wellbore length. A communication link 7 connects sensor 8 with unit 18, and optionally other units not illustrated. Communication link 7 may be fiber optic, hard wire, or wireless. Although communication link 7 is illustrated as traversing through tubular 2 and tubular section 4, link 7 may traverse in the annulus between tubular 2 and wellbore or production casing 3.

Systems of the invention include those wherein the temperature sensors may be selected from thermally active temperature sensors and thermally passive temperature sensors, and wherein the flow meters may be selected from flow meter spinners, electromagnetic flow meters, pH sensors, resistivity sensors, optical fluid sensors and radioactive and/or non-radioactive tracer sensors, such as DNA or dye sensors. Systems of the invention may include means for using this information in realtime to evaluate and change, if necessary, one or more parameters of the fluid diversion. Means for using the information sensed may comprise command and control subsystems located at the surface, at the tool, or both. Systems of the invention may include downhole flow control devices and/or means for changing injection hydraulics in both the annulus and tubing injection ports at the surface. Systems of the invention may comprise a plurality of sensors capable of detecting fluid flow out of the tubular, below the tubular and up the annulus between the tubular and the wellbore in realtime mode that may have programmable action both downhole and at the surface. This may be accomplished using one or more algorithms allow quick realtime interpretation of the downhole data, allowing changes to be made at surface or downhole for effective treatment. Systems of the invention may comprise a controller for controlling fluid direction and/or shut off of flow from the surface. Exemplary systems of the invention may include fluid handling sub-systems able to improve fluid diversion through command and control mechanisms. These sub-systems may allow controlled fluid mixing, or controlled changing of fluid properties. Systems of the invention may comprise one or more downhole fluid flow control devices that may be employed to place a fluid in a prescribed location in the wellbore, change injection hydraulics in the annulus and/or tubular from the surface, and/or isolate a portion of the wellbore.

The inventive systems may further include different combinations of sensors/measurements above and below, (and may also be at) a fluid injection port in the tubular to determine/verify diversion of the fluid.

Systems and methods of the invention may include surface/tool communication through one or more communication links, including but not limited to hard wire, optical fiber, radio, or microwave transmission. In exemplary embodiments, the sensor measurements, realtime data acquisition, interpretation software and command/control algorithms may be employed to ensure effective fluid diversion, for example, command and control may be performed via preprogrammed algorithms with just a signal sent to the surface that the command and control has taken place, the control performed via controlling placement of the injection fluid into the reservoir and wellbore. In other exemplary embodiments, the ability to make qualitative measurements that may be interpreted realtime during a pumping service on coiled tubing or jointed pipe is an advantage. Systems and methods of the invention may include realtime indication of fluid movement (diversion) out the downhole end of the tubular, which may include down the completion, up the annulus, and in the reservoir. Two or more flow meters, for example electromagnetic flow meters, or thermally active sensors that are spaced apart from the point of injection at the end of the tubular may be employed. Other inventive methods and systems may comprise two identical diversion measurements spaced apart from each other and enough distance above the fluid injection port at the end or above the measurement devices, to measure the difference in the flow each sensor measures as compared to the known flow through the inside of the tubular (as measured at the surface).

The inventive methods and systems may employ multiple sensors that are strategically positioned and take multiple measurements, and may be adapted for flow measurement in coiled tubing, drill pipe, or any other oilfield tubular. Systems of the invention may be either moving or stationary while the operation is ongoing. Treatment fluids, which may be liquid or gaseous, or combination thereof, and/or combinations of fluids and solids (for example slurries) may be used in stimulation methods, methods to provide conformance, methods to isolate a reservoir for enhanced production or isolation (non-production), or combination of these methods. Data gathered may either be used in a "program" mode downhole; alternatively, or in addition, surface data acquisition may be used to make real time "action" decisions for the operator to act on by means of surface and downhole parameter control. Fiber optic telemetry may be used to relay information such as, but not limited to, pressure, temperature, casing collar location (CCL), and other information uphole. As described therein, due to the large ID of a straddle tool, a measurement tool is placed inside the straddle tool housing. A hole is added to the bullnose, and a tube is run from below the lower seal to inside the measurement tool. The measurement tool may then measure treating pressure, bottomhole temperature, depth via casing collar location (CCL), or some other parameter, as well as pressure below the lower seal of the straddle, which may be measured in real-time. By measuring the pressure below the lower seal, the operator can tell if the lower seal is leaking, and also if there is cross-flow from one zone to another. This has the potential to change how the job is performed in real time and optimize the treatment. This data would be evaluated realtime to determine if another treatment of zone is necessary.

The inventive methods and systems may be employed in any type of geologic formation, for example, but not limited to, reservoirs in carbonate and sandstone formations, and may be used to optimize the placement of treatment fluids, for example, to maximize wellbore coverage and diversion from high perm and water/gas zones, to maximize their injection rate (such as to optimize Damkohler numbers and fluid residence times in each layer), and their compatibility (such as ensuring correct sequence and optimal composition of fluids in each layer).

The interpretation method proposed in the invention is illustrated by the following examples.

Example 1

Interpretation of Bottomhole Temperature Data

An acid stimulation treatment was performed in an open-hole section of a horizontal well in a carbonate formation. The treatment objective was to remove drilling induced damage. By default, the injected treatment fluids take the path of least resistance and invade the regions that are more permeable than others. However, it was difficult to pin-point the regions where the fluids were being injected because the initial injectivity of the zones and how injectivity changes with time was not known. Therefore, monitoring of fluid placement was performed for evaluation and optimization of the treatment.

Figure 5:
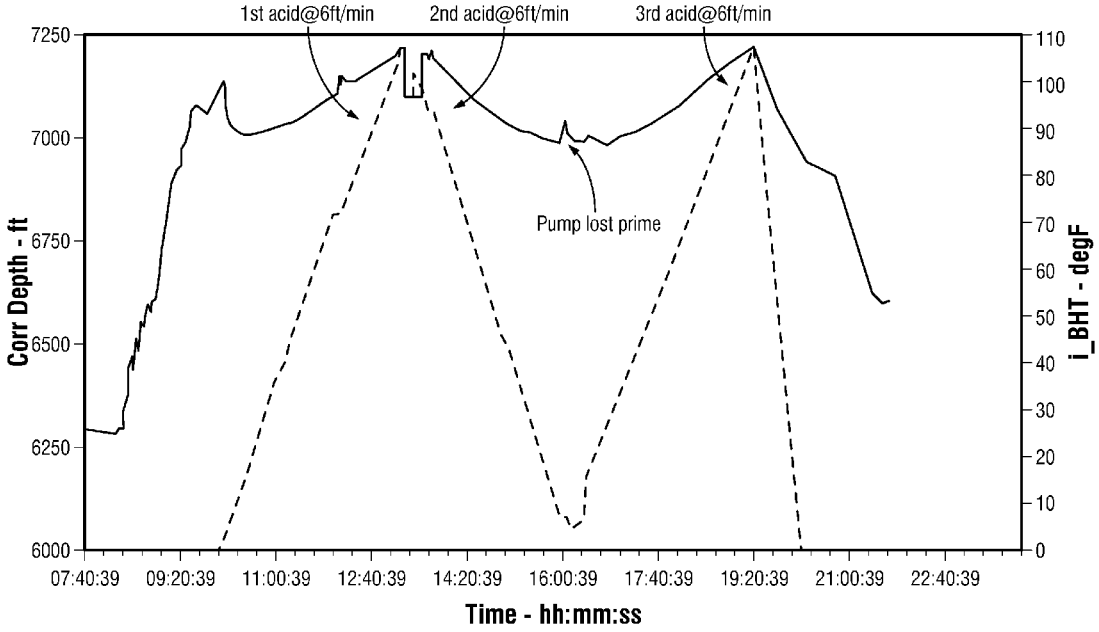
FIGS. 5, 6 and 7 are plots of curves useful in one or more methods of the invention.

The plot in FIG. 5 shows bottomhole temperature data obtained during the acid stimulation treatment. The bottom curve, shaped like an "M" depicts the coiled tubing depth, whereas the second curve shows the bottomhole temperature. A temperature sensor was located in the bottomhole assembly on the end of the CT. Prior to start of the acid treatment, brine was pumped from the coiled tubing while running in the hole to the heel. During this phase of the treatment the well was open to the pit, where returns were monitored. During the main treatment the acid was continuously pumped with the CT moving up and down the lateral length at a rate of nearly 6 feet/min [1.83 m/min] and the injection rate was constant at nearly 2 bbl/min [0.32 $m^3$/min]. At the start of the job (left part of the plot), one can see that as the pumping of acid began and the formation was exposed to the acid stimulation fluid, the bottomhole temperature started to decrease. However, the temperature increased as the CT traversed down the lateral section. This can mislead one into believing that the majority of the fluids invaded the heel of the lateral. Therefore, though temperature is a useful measurement which may hold the key to solving the problem, its representation alone in graphical format was insufficient to draw any meaningful conclusions as to where the fluid invasion was actually taking place in the open-hole formation.

Figure 6:
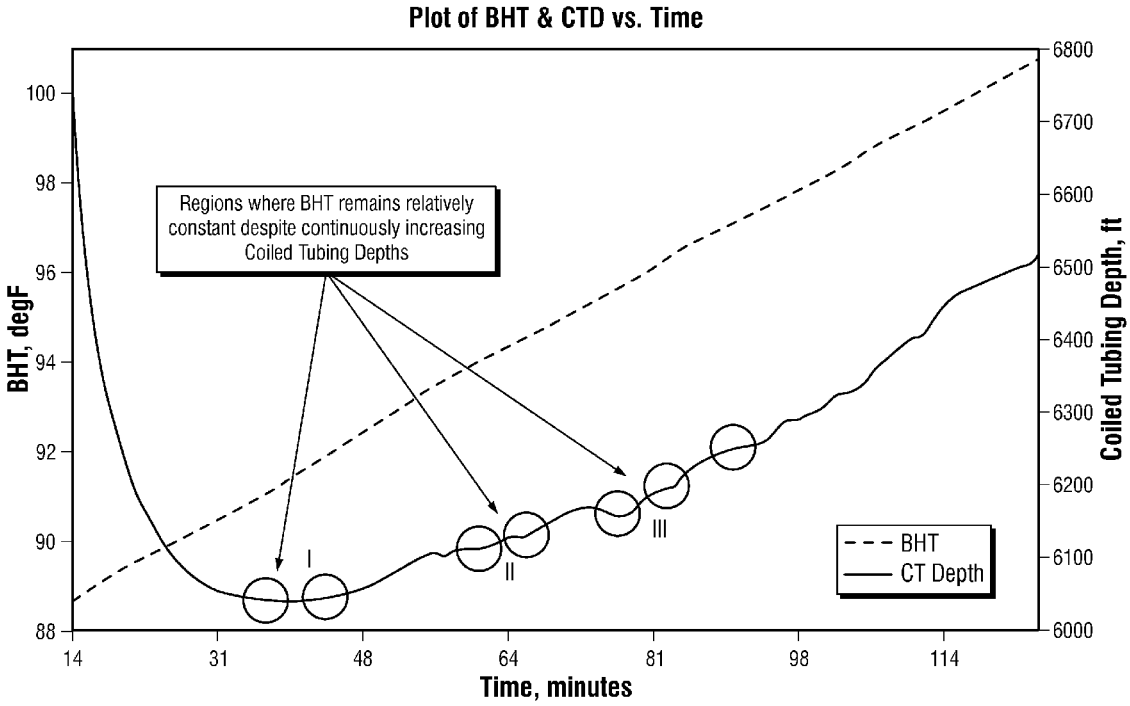

The plot of FIG. 6 represents the data of "1st Acid" treatment in context with entire job data shown in FIG. 5. A closer look at the data indicated that the rate of change of bottomhole temperature was not constant even though the CT was moving at a constant rate of 6 ft/min [1.83 m/min] and the acid injection was taking place at a near constant rate of 2 bbl/min [0.32 $m^3$/min]. The bottomhole temperature sensor was placed a few feet before the distal tip of the CT, and thus a change in temperature (increase or decrease) was observed when the fluid came out of the CT, that had a different temperature than the surroundings. The injected acid fluid either passed over the sensor in a direction opposite to that of CT movement, or if the CT sensor entered a region which was invaded earlier, if the fluid flow was in the same direction as CT movement. The fact that the entire section of the well was completed as open hole meant that the fluid was free to take the path of least resistance; in this case it seemed to be somewhat away from the heel towards the toe of the lateral. The initial rapid reduction in bottomhole temperature indicated that the bottomhole temperature sensor was moving into a "cooler region"; where most of the fluid had already invaded ahead of the sensor and had cooled the region down before the sensor reached that point. In short, this example showed that the initial fluid movement was mostly in the direction of CT movement.

When the sensor reached the region marked "I" in FIG. 6, there was little change in the value of bottomhole temperature, which was indicated by "flats" in the bottomhole temperature profile. This arrested rate of change of bottomhole temperature indicated that the majority of the region marked under "I" was at an identical temperature; the expanse of this region is easily seen from the difference in CT depth value from its curve. This lead to the first interpretation that sufficient fluid had penetrated this region to keep its temperature near constant over a length of nearly 75 ft [22.9 m] from 6175 ft to 6250 ft [1882 m to 1905 m]. In short, when looking at bottomhole temperature curves during acid stimulation treatment using point temperature measurement, one should try to identify "flats" or areas where bottomhole temperature shows little change with CT movement.

In FIG. 6, a look at bottomhole temperature profile immediately after Region I suggested that as the sensor moved away from the previously encountered "colder" region, it started experiencing slightly warmer temperatures; the rate of change of bottomhole temperature had gained a positive value indicating a region where fluids may not have invaded. However, since the injection was continuously progressing, the fluid could go in the direction that offered lowest resistance. This may have been in the region that had been left "behind" the CT tip, the region "ahead" or both. For example, if there were no permeable zones after Region I, the bottomhole temperature would have continued to increase, although now the direction of fluid flow would have been opposite to CT movement because there would have been fewer favorable zones ahead of the CT. In such cases, as the tip moved further away from the receptive zone that was left "behind", higher annular friction may have been encountered for fluid which had to traverse the greater distance. This change in bottomhole pressure could have been detected by monitoring the bottomhole pressure curve, which may be plotted alongside. In this example though, the recurrence of bottomhole temperature "flats" (rate of change of temperature close to zero) indicated that there were other regions that had cooled down as a result of acid fluid invasion, and arrested the rate at which temperature was increasing before the sensor crossed those regions. FIG. 6 shows an increase of nearly 2° F. [1.1° C.] to Region II and around 0.5° F. [0.28° C.] to the first part of Region III. Note that the initial bottomhole temperature encountered in Region III was less than the preceding temperature, indicating a "cool down".

Example 2

The Use of Temperature Derivative Plots for Interpretation

Figure 7:
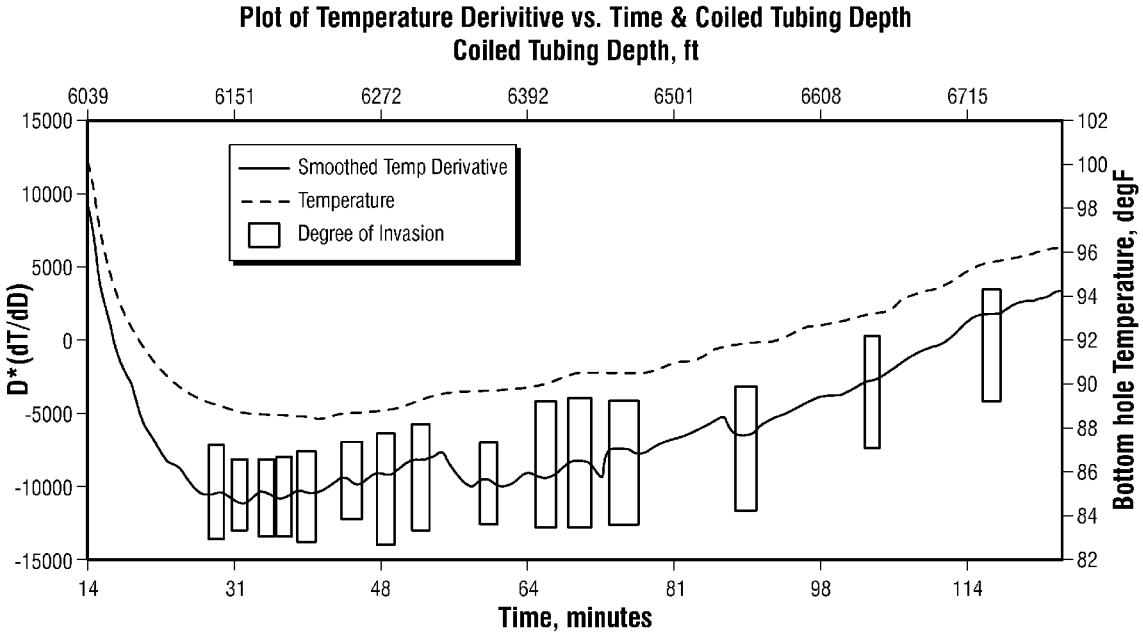

In this example, data for the acid job presented in Example 1 is used to illustrate the use of temperature derivative plots for interpretation in accordance with a method of the invention. FIG. 7 shows the temperature derivative curve (lower curve) which distinctly shows the regions where rate of change of bottomhole temperature was near zero. This provided a better indication of quantifying the extent of fluid taking regions, rather than getting an estimate from the bottomhole temperature curve alone. As is evident from a comparison of FIGS. 6 and 7, the temperature derivative curve was able to "split" the larger region estimated between 6175 and 6250 ft [1882 m to 1905 m] into several smaller regions. There were also a few other regions visible that were not clearly evident when using bottomhole temperature plot alone. Therefore, the temperature derivative curve generated using t*dT/dt and D*dT/dD vs. Time (or any (t+Dt)/Dt where T=temperature, t=time, D=CT Depth allowed much more accurate interpretation. Smoothing of the curve, as is seen in plot of FIG. 7 was performed by use of a standard, readily available algorithm.

Example 3

Fluid Invasion in the Reservoir

In this example data for the acid job presented in Examples 1 and 2 was used to illustrate how fluid invasion can be quantified. The solid bars shown in FIG. 7 represent the degree of fluid invasion across the various zones. Based on the nature of the slope of the derivative in the identified "zones", this method of the invention determined and assigned the degree of invasion of fluid and represented the same in graphic format; FIG. 7 shows them as "bars" of varying dimensions based on perceived effectiveness of stimulation. The method estimated the degree of invasion by taking into account the angle of separation from a base line of 0 degrees; with the degree of invasion diminishing as the angle approaches 90 degrees.

Example 4

Quantification of Pre-Treatment Damage

This example demonstrates a method to compute pre-job skin on-the-fly based on Darcy's equation. Pre-stimulation treatment skin may be determined during the initial pass in this diagnostic method where an inert fluid is injected into the formation. Some of the inputs required for the calculation, i.e., pressure drop, rate of injection, height of pay (or region of invasion), volume factor, fluid viscosity, and the like are known values. Unknowns are reservoir pressure and an estimated value of permeability, which may be obtained from the client. Any change in the skin factor during the matrix acidizing treatment may then be computed with a better knowledge of fluid invasion profiles.

Example 5

Interpretation of Temperature History Along the Length of the Wellbore

In the acid job described in Example 1, locations in the reservoir section of the wellbore were visited multiple times (FIG. 5). This data may be used to create temperature history for various sections of the reservoir. The rate of change in temperature at any location may be correlated with fluid invasion in the zone. Therefore, if the derivative and bottom-hole temperature plots generated during various phases of the treatment are plotted together vs. depth along the wellbore, then the zones which show the most rapid change in temperature can be identified.

Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method comprising:

inserting a tubular into a wellbore, the tubular comprising a tubular section having at least one treatment fluid injection port;

injecting a treatment fluid through the at least one fluid injection port to contact a hydrocarbon-bearing reservoir of the wellbore;

monitoring a movement of the treatment fluid in the reservoir by providing one or more sensors for measurement of one of temperature and pressure;

predicting temperature as a function of reservoir permeability distribution at the one or more sensors placed at known locations on the tubular;

measuring actual temperatures at the one or more sensors; and calculating error between the predicted and the measured temperatures, and minimizing the errors by iteratively adjusting the permeability distribution along the wellbore length.

2. The method of claim 1 wherein the sensors are disposed on the tubular to maintain a given spacing between the sensors and the fluid injection port.

3. The method of claim 1 further comprising adjusting one or more parameters selected from composition of the treatment fluid, injection rate of the treatment fluid, and pressure of the treatment fluid in response to the monitoring of the treatment fluid movement.

4. The method of claim 3 wherein the adjusting is made in real time.

5. The method of claim 1 wherein the tubular is coiled tubing.

6. The method of claim 5 wherein coiled tubing extends substantially along a full length of a wellbore extending into the reservoir.

7. The method of claim 1 wherein the treatment fluid and a second fluid are injected from different flow paths.

8. The method of claim 1 comprising moving the tubular during the monitoring.

9. The method of claim 1 further comprising measuring time of arrival of the injected treatment fluid at the temperature sensor.

10. The method of claim 9 further comprising providing two or more temperature sensors and measuring the time for the injected treatment fluid to travel between two temperature sensors.

11. The method of claim 1 further comprising:

injecting the treatment fluid through the tubular, through the tubular section, and through the at least one treatment fluid injection port, the treatment fluid having a first fluid property value;

injecting a second fluid through an annulus between the tubular and the wellbore, the second fluid having a second fluid property value that is different from the first fluid property value; and measuring a differential between the first and second fluid property values.

12. The method of claim 11 comprising tracking a fluid interface between the treatment fluid and the second fluid, and if the interface is not at a desired location in the wellbore, adjusting flow rate of the treatment fluid, the second fluid, or both to move the interface to the desired location.

13. A system comprising:

a tubular adapted to maintain a given spacing between one or more sensors for measurement of one of temperature and pressure in a hydrocarbon-bearing reservoir, the tubular comprising a fluid inlet, a fluid passage, and at least one treatment fluid injection port;

means for monitoring movement of a treatment fluid in the reservoir;

a prediction unit for predicting a temperature as a function of reservoir permeability distribution at one or more sensors placed at known locations on the tubular;

means for inserting the tubular into the wellbore;

a pump for injecting the treatment fluid through the tubular, through the fluid passage, and through the at least one treatment fluid injection port;

a measuring unit for measuring actual temperatures at the one or more sensors; and a calculation unit for calculating error between the predicted and the measured temperatures, and for minimizing the errors by iteratively adjusting the permeability distribution along the wellbore length.

14. The system of claim 13 further comprising:

a unit for generating diagnostic plot curves of temperature derivative with respect to time and temperature derivative with respect to the tubular depth, both obtained at a known fixed distance from the treatment fluid injection port; and a curve shape interpreting unit for interpreting the curves to determine location of regions of a hydrocarbon-bearing reservoir exhibiting flow of the injected fluid, where the flow ranges from zero to a non-zero value.

15. The system of claim 13 further comprising a measuring unit for measuring time of arrival of the injected treatment fluid at the temperature sensor.

16. The system of claim 13 further comprising:

a first pump for injecting the treatment fluid through the tubular, through the section of tubular, and through the at least one treatment fluid injection port, the treatment fluid having a first fluid property value;

a second pump for injecting a second fluid through an annulus between the tubular and the wellbore, the second fluid having a second fluid property value that is different from the first fluid property value; and a measuring unit for measuring a differential between the first and second fluid property values.

17. The system of claim 13 wherein the tubular comprises coiled tubing.

* * * * *